United States Patent [19]

Day et al.

[11] 4,418,720

[45] Dec. 6, 1983

[54] SOLENOID OPERATED DIRECTIONAL VALVES HAVING MODULAR CONSTRUCTION

[75] Inventors: Curtis H. Day, Manchester; Ronald L. Loup, Clarkston, both of Mich.

[73] Assignee: Double A Products Company, Manchester, Mich.

[21] Appl. No.: 241,355

[22] Filed: Mar. 6, 1981

[51] Int. Cl.[3] ..... F15B 13/044

[52] U.S. Cl. ..... 137/625.65; 137/554; 251/137; 339/64 M

[58] Field of Search ..... 137/554, 625.65; 251/137; 339/64 R, 64 M, 252 R, 252 S, 256 R, 198 R, 263 R, 268 R

[56] References Cited

U.S. PATENT DOCUMENTS 3,717,179 2/1973 Clark ..... 137/625.65

4,308,891 1/1982 Loup ..... 137/625.65 X

FOREIGN PATENT DOCUMENTS 2753172 5/1979 Fed. Rep. of Germany ... 339/198 R

*Primary Examiner*—Gerald A. Michalsky

*Attorney, Agent, or Firm*—Stephenson & Boller

[57] ABSTRACT

Solenoid operated directional valves are disclosed which have a modular construction wherein electrical connections between component parts are made integral and concurrent with the act of mounting the component parts together. The modular construction means that no separate lead wires are required to be connected between the component parts. The modular construction: reduces the time required to assemble valves in the factory; facilitates installation and maintenance procedures in the field; permits optional features to be selectively incorporated into or removed from valves in a non-destructive waste-free fashion; and essentially eliminates the possibility of improperly connecting electrical circuits within valves.

17 Claims, 25 Drawing Figures

SOLENOID OPERATED DIRECTIONAL VALVES HAVING MODULAR CONSTRUCTION

CROSS REFERENCE TO A RELATED PATENT APPLICATION

The present application is related to co-pending U.S. patent application Ser. No. 135,974, filed Mar. 31, 1980, now U.S. Pat. No. 4,308,891, and commonly assigned with the present application.

BACKGROUND AND SUMMARY OF THE INVENTION

The present invention pertains to solenoid operated directional valves such as are used in hydraulic systems to control the direction of hydraulic fluid flow and is more specifically directed to the electrical connector and terminal structure of such valves.

The cross referenced co-pending U.S. patent application Ser. No. 135,974, now U.S. Pat. No. 4,308,891, addresses a number of problems inherent in prior solenoid operated directional valves and provides a new and unique solution to those problems. The present invention in one respect represents a still further improvement in solenoid operated directional valves.

Some of the problems encountered with solenoid actuated directional valves prior to the inventions of the present and the cross referenced patent applications include: the difficulties of servicing the valves in the field and of installing them in relation to available electrical sources; the possibility that incorrect electrical connections may be made during assembly, installation, or maintenance of the valves; and the restrictions which might be imposed by pertinent local codes. For example, a valve might be mounted on a piece of equipment without knowledge of the direction from which the source of electric power is to be supplied and without knowledge of any mounting restrictions that may exist. In order to properly connect the valve to the available electric power supply it might be necessary to reorient the location where the supply wires enter the valve. In prior valves this typically involved some disassembly of the valve and a substantial amount of rewiring the individual lead wires of the various circuits. With this procedure the possibility existed that the lead wires might not be properly reconnected resulting in improper operation and the potential for damage to or failure of equipment.

The invention of the subject cross referenced U.S. patent application provides a new and unique solution to the problem of having to reorient the electrical connection to a solenoid valve, whereby reorientation can be accomplished expeditiously without the need to perform any rewiring of individual circuits but with full assurance that correct continuity of individual circuits will be maintained. A resultant benefit is that installation and maintenance costs can be reduced in the field. The invention of the cross referenced application also ensures that in the case of double solenoid valves having associated indicator lights which indicate which of the two solenoids is energized, each lamp will continue to be properly connected to the correct solenoid after reorientation.

The invention of the present application provides a solenoid operated directional valve of modular construction wherein electrical connections between the various component parts of the assembly are made integral and concurrent with the act of mounting the component parts together. With the modular construction there are no separate lead wires which have to be individually connected, and continuity of circuit operation is assured both at original assembly and after any subsequent reassembly for maintenance or modification purposes. Assembly time at the factory and maintenance time in the field are significantly reduced.

Furthermore, the invention provides a substantial degree of versatility both with respect to fulfilling individual customer requirements from the factory as well as for service, installation and/or modification purposes in the field. Depending upon requirements of a given customer, various features may be selectively incorporated into the valve as the customer wishes. This allows the manufacturing of the valve assembly to start with a base valve unit to which various options may be selectively added. Service inventory requirements can be simplified because it is unnecessary to stock a full range of unique complete valve assemblies. Rather, if a given model of valve assembly is desired, it may be developed from the base valve unit by simply adding the appropriate component parts, which may be done with expediency and once again without any separate lead wires to connect. Similarly, modifications may be made to remove optional features from a valve, and this likewise can be done with expediency and without any separate lead wires to rewire. In all instances continuity of circuitry is assured. Any modification, by way of either addition or subtraction of component parts, is accomplished in a non-destructive and waste-free fashion so that a valve assembly from which component parts are removed may at a later time either be used for its remaining component parts or rebuilt into a functional assembly of a desired configuration.

The invention also provides compatability with domestic and foreign requirements. For example, foreign requirements either mandatory or customarily accepted in the trade, may be somewhat different from corresponding U.S. requirements. With the present invention the base valve unit may be used for either foreign or domestic applications and the additional component parts may be selected with a view to the requirements of the particular application, be it foreign or domestic.

As an example of the substantial advantages and benefits of the present invention consider a situation where a conventional prior type of solenoid valve is installed in use in a manufacturing plant and requires service. Often the valve is in a poor location for access by maintenance personnel. In such a situation they may completely disconnect the wiring and hydraulic lines to the valve, remove the valve as a unit from its mounting and replace it with a new one, leaving the defective valve to be repaired at the bench. Such a procedure will usually involve a substantial amount of machine downtime, and furthermore it may require an appreciable amount of bench time to fix the defective valve. Such a procedure impairs the operating efficiency of the machine and of the plant. Moreover, in union plants the service procedure may require that both a hydraulic technician and an electrical technician be present because both electrical and hydraulic apparatus are involved. Where the valve must be rewired, the possibility exists that the electrical wires may not be properly reconnected, and this can lead to failure of the valve and/or associated equipment and contribute to further inefficiency.

If an attempt is made to service a faulty solenoid valve of the prior art type without removing it as a unit from the equipment on which it is mounted, other problems may arise. For example, if only a defective solenoid needs to be replaced, the construction may be such that a significant amount of disassembly is needed possibly encompassing more than just the solenoid per se. This could lead to misconnected wires upon reassembly and to other problems. Also certain solenoids are susceptible to damage during the re-installation process. For example, a solenoid is secured to the valve body by means of a nut which is tightened against the solenoid casing. If care is not taken in tightening the nut, it may be overtorqued to the point of cracking the solenoid casing. In addition to the destruction of the solenoid in such a situation, further downtime results.

From these foregoing examples it can be seen that prior valves do present inefficiencies when considered in the context of installation and maintenance at the plant site.

The present invention by contrast substantially alleviates or eliminates entirely the problems of prior valves. For example, if it is necessary to service only the electrical portion of the valve, such service can be conveniently done without removal of the valve from the machine and having to disconnect hydraulic lines. Furthermore, such service can be accomplished without the necessity of disconnecting individual wires and reconnecting them later. If it is necessary to replace only a solenoid, the present invention allows a solenoid to be replaced simply by unplugging the defective solenoid and plugging in a new one. Likewise if it is necessary to service the electrical structure which forms the electrical connection from the solenoid to the electrical source, only the junction box cover need be removed to provide access to the component parts which can then be conveniently removed and replaced without having to make any wiring disconnections and reconnections.

The foregoing features, advantages and benefits of the invention, along with additional ones, will be seen in the ensuing description and claims wherein like reference numerals designate like parts in the various drawing figures. The drawings disclose preferred embodiments of the invention according to the best mode presently contemplated in carrying out the invention.

DESCRIPTION OF THE PREFERRED EMBODIMENT

Figure 1:
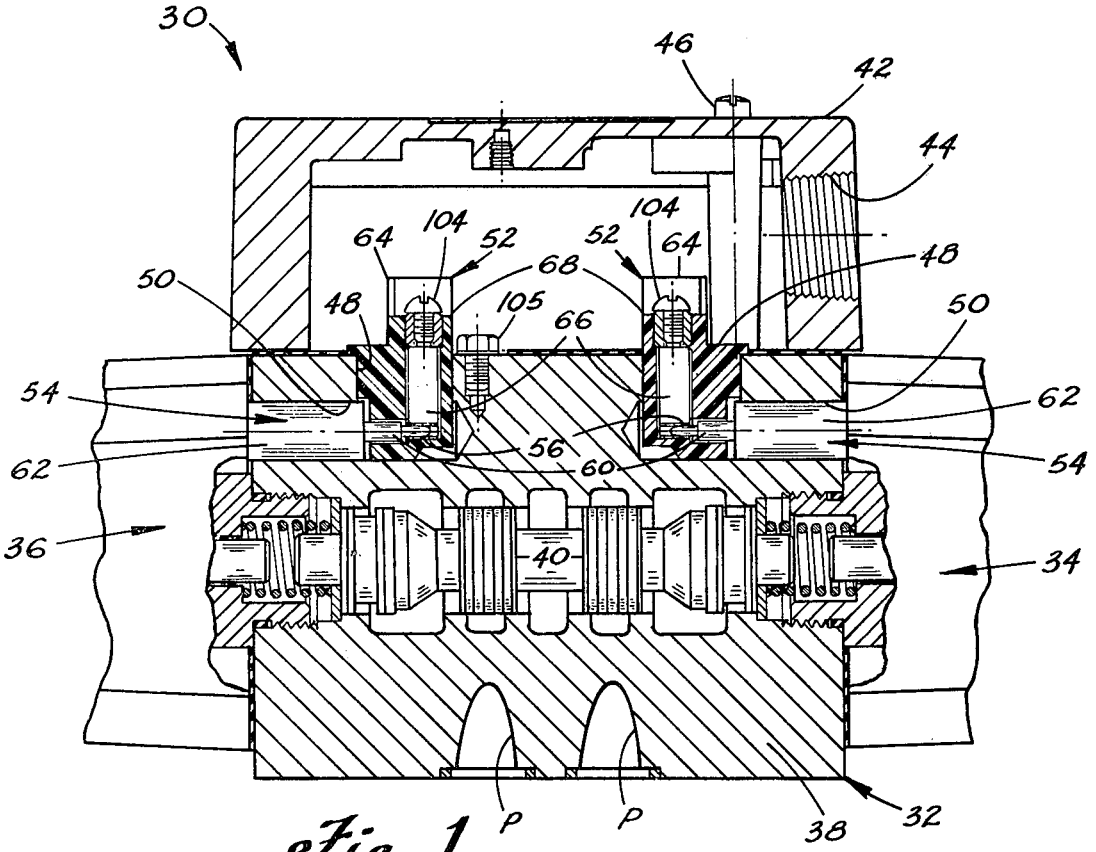
FIG. 1 is a front vertical sectional view having portions broken away, illustrating a first embodiment of solenoid valve according to principles of the present invention.

FIG. 1 illustrates a first embodiment of valve 30 embodying principles of the present invention. The disclosed valve is a double solenoid, directional valve type comprising a valve assembly 32 with a solenoid assembly 34 on the right-hand end and a solenoid assembly 36 on the left-hand end. The valve assembly comprises a valve body 38 within which a spool 40 is shifted by selective energization of the solenoid assemblies to control the directional flow of hydraulic fluid via ports p to which various hydraulic lines are connected. The present invention is applicable to various types of directional valves, and hence the hydraulic details, such as the construction of spool 40 and the porting, may be any of a wide variety of specific types. For example, the valve may be a conventional four-way spring-return valve, such as is utilized to control the position of a piston in a hydraulic cylinder. In that type of valve, when one of the two solenoids is energized, hydraulic fluid from a hydraulic pump flows through the valve to one side of the piston while the opposite side of the piston is connected back through the valve to tank. When that solenoid is deenergized and the valve closes, there is no further hydraulic flow to the cylinder. When the other solenoid is energized, the flow of hydraulic fluid reverses.

The present invention pertains to the electrical structure of the valve via which the solenoids receive energizing current. Continuing further with FIG. 1, electrical terminal structure is located at the top of valve body 38 and is enclosed by a removable junction box cover 42. The right side wall of cover 42 contains a threaded aperture 44 providing for connection of a mating fitting on a wire-containing conduit assembly (not shown) whereby the electrical wires (not shown) to the valve are protected. The cover is removably secured to the valve body by one or more fastening screws 46 which engage tapped holes (not shown) in the top surface of the valve body.

Associated with each solenoid assembly is corresponding electrical connector structure. For each solenoid a vertical bore 48 and a horizontal bore 50 are provided in the valve body. Each vertical bore 48 extends downwardly for a predetermined distance from the top surface, and is located to side of a vertical center line through the valve. Each horizontal bore 50 extends inwardly from the end surface which faces the corresponding solenoid assembly to intersect the associated vertical bore 48.

Disposed within each vertical bore 48 is a corresponding terminal block assembly 52 which has been inserted into the open upper end of the bore before the corresponding solenoid has been mounted on the valve body. Projecting from the end of the solenoid which is toward the valve body is a connector plug structure 54. The connector plug structure comprises a pair of plug-in type electrical terminals 56 at the distal end of a small protuberance 60 which is in turn at the distal end of a larger protuberance 62. Terminals 56 and the two protuberances are of generally circular cylindrical shape, and the noses of the terminals may be rounded as shown. As will be more fully explained in the ensuing description, terminals 56 of each solenoid assembly mate with corresponding terminals of the corresponding terminal block assembly 52 to provide for electrical connection of the solenoid integral and concurrent with the act of mounting the solenoid on the valve body. This is a wireless type connection and eliminates the problems inherent in wire connections as explained above.

Greater detail can be seen in FIGS. 4–10. Each terminal block assembly 52 comprises a terminal block 64 of an electrically non-conductive material, for example a suitable plastic. The block provides electrical insulation with respect to the conductive metal constituting the valve body. Two individual electrical conductive paths are provided by each terminal block assembly, and in the illustrated embodiment each electrical conductive path is provided by a terminal 66 formed from strip material and an annular threaded terminal 68. Each terminal block comprises an intermediate circular cylindrical portion 70 whose outside diameter is sized to fit closely within a vertical bore 48. A plurality of circumferentially spaced ribs 72 extend in a direction lengthwise of tubular portion 70 around the outside thereof. Running adjacent each rib 72 is a corresponding slot 74. The ribs and corresponding slots provide a retention arrangement for securely retaining the terminal block assembly in the corresponding bore, yet an arrangement which will permit the assembly to be removed conveniently from the valve body when such is desired. Each rib is canted at an angle and the lower leading edge is inclined whereby upon installation of the terminal block assembly, ribs 72 flex inwardly into the corresponding slots 74. The plastic material has a certain resiliency whereby the ribs exert a radially outwardly directed force against the wall of the bore to retain the insert in the bore.

The lowermost portion 76 of the terminal block projects below the tubular portion 70 and comprises a pair of spaced apart parallel holes 78. These holes face the corresponding solenoid terminals 56 with the terminals entering the holes when the solenoid assembly is mounted to the valve assembly. It will be noted that the intersecting bores 48 and 50 are drilled such that the main circular cylindrical section of the vertical bore does not fully intersect the main circular cylindrical section of the horizontal bore. This leaves a residual structure at the intersection of the two bores corresponding to the tip of the drill which made the vertical bore. The bottom portion of the terminal block is shaped to coact with that structure such that upon full insertion of the terminal block assembly into the vertical bore, it automatically circumferentially aligns whereby the holes 78 face in the correct alignment for reception of the solenoid terminals 56.

Figure 9:
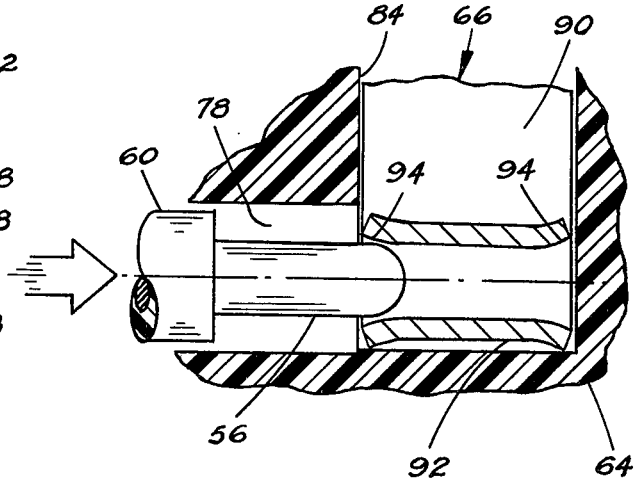
FIG. 9 is an enlarged fragmentary sectional view illustrating the relative positions of a portion of the assembly of FIG. 8 and a related mating part during an assembly step.
Figure 5:
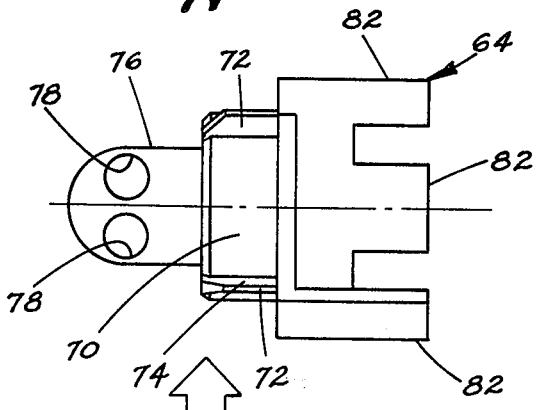
FIG. 5 is a left side view of the element of FIG. 4.
Figure 4:
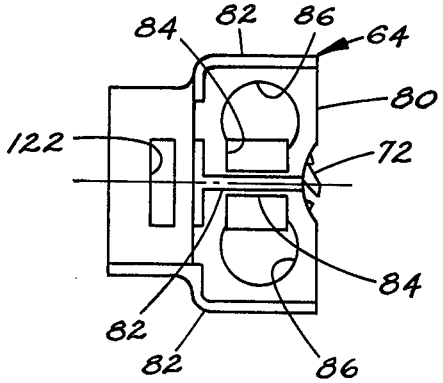
FIG. 4 is a top plan view of one of the elements used in the valves of FIGS. 1, 2 and 3, but shown by itself.
Figure 6:
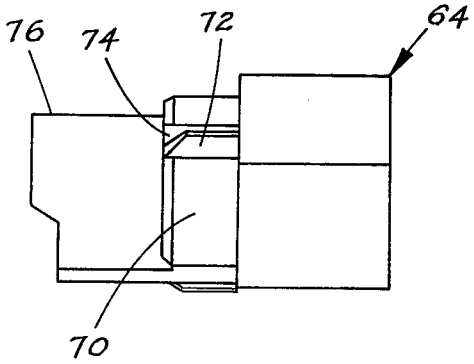
FIG. 6 is a front view of the element FIG. 4 taken in the direction of arrow 6 in FIG. 5.
Figure 7:
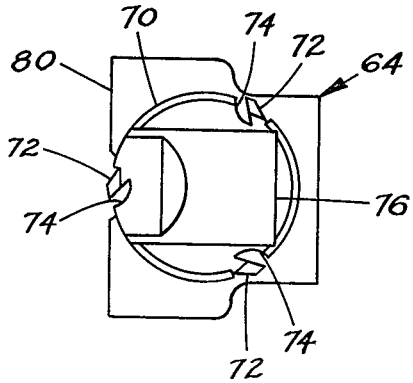
FIG. 7 is a bottom view of the element of FIG. 4.

The inner end of each hole 78 is intercepted by a vertical hole 84 of non-circular cross section. Each hole 84 extends toward the top of the terminal block where it intercepts a corresponding, axially offset, circular hole 86. The particular shapes of the holes 84, 86 are to accommodate the particular terminals 66, 68, a terminal 66 being disposed predominantly in a non-circular hole 84 and a terminal 68 being disposed in a circular hole 86. Each terminal 66 is formed from electrically conductive material into the illustrated shaped best seen in FIG. 10. Basically the terminal comprises a flanged tab 88 at the upper end thereof (right end as viewed in FIG. 10), an intermediate compliant portion 90, and a curled receptacle portion 92 at the bottom. The overall length of the terminal is such that in the assembled position of FIG. 8 the curled receptacle portion 92 is disposed in alignment with the corresponding hole 78 for reception of the corresponding solenoid terminal 56. The flanged tab 88 is disposed against the horizontal bottom wall of the circular hole 86, and the compliant portion 90 is disposed within the rectangular hole 84. The annular terminal 68 is secured by any suitable means, for example by means of a press fit, into the circular hole 86 and forcefully engages the flanged tab 88 so as to retain the terminal 66 in the terminal block while at the same time making a suitable electrical contact between the two terminals. As best seen in FIG. 9, the opposite ends of the curled receptacle portion 92 are flared as at 94 and the flared end facing the solenoid provides a lead for facilitating the insertion of the corresponding solenoid terminal 56 into electrical conductive engagement therewith.

The mounting of each terminal 66 in the terminal block and the mounting of the terminal block on the valve assembly are such that each tab 88 may be considered as fixedly mounted on the valve body. While the arrangement and construction are such that the curled receptacle portions 92 are disposed substantially in alignment with the corresponding terminals 56 of the solenoid assembly, practical manufacturing considerations do not guarantee a precision alignment. This is where a true advantage of the present invention becomes apparent. In considering the compliant portion 90, it will be seen that there are four distinct segments 96, 98, 100, 102. The intermediate segments 98 and 100 form, as viewed in FIGS. 8 and 10, a V-shaped bend with respect to the segments 96, 102 endowing the curled receptacle portion with a certain degree of mobility which compensates for any slight misalignments between solenoid terminals 56 and receptacles 92. The solenoid terminals are essentially rigid, and hence the compliant portions will absorb by slight twisting and/or flexing any misalignments thereby guaranteeing proper electrical mating.

A further advantage is demonstrated when the actuation of the solenoids is considered. The energization of a solenoid can result in high internal reaction forces on various components of the valve assembly. Such forces can lead to problems in maintaining integrity of electrical circuit connections and it is believed fair to say that this has rendered prior attempts at incorporating plug-in type solenoids unsuccessful. However, the present invention renders the electrical connection highly immune to the effects of such shock loads, and makes plug-in type solenoids practical.

Considering still further the assembly of the solenoid to the valve, it will be appreciated that the proper assembly sequence requires for the preferred embodiment that the terminal block assemblies be mounted on the valve body prior to the assembly of the solenoids to the valve body. With this fact in mind it will be seen that upon assembly of a solenoid to the valve body the construction and arrangement is such that the protuberance 62 engages the horizontal bore 50 prior to either the smaller protuberance 60 entering hole 78 or the solenoid terminals 56 engaging the curled receptacles 92. Thus just before the solenoid terminals 56 enter their respective curled receptacles 92, they are in close alignment. Any slight misalignments are inherently compensated with the disclosed construction. It will be recognized that in the preferred practice the dimensions involved are relatively small and hence the patent drawings may in certain instances not show slight clearances which may exist. For example, certain clearances can be seen in FIG. 9 which will allow the compliant portion to be effective in securing the alignment of the mating terminal portions.

FIG. 1 illustrates one possible arrangement for effecting electrical connection of the external wiring to the valve assembly. This involves a connecting screw 104 screwed into each one of the threaded annular terminals 68. In the interest of clarity the drawing figures does not disclose the actual wiring and leads coming into the junction box and making connection with the terminals; however in the typical arrangement each individual circuit wire would terminate in an eyelet type connector which would be placed in alignment with the corresponding terminal 68 and the corresponding screw 104 then passed through the eyelet and tightened to hold the eyelet in secure electrical and mechanical contact with the terminal. The partition structure 82 on the top of the terminal block provides for partitioning between the respective eyelet terminals. There is also shown a ground screw 105 which is threaded into the valve body to provide for a connection of a ground wire to the valve body.

Figure 11:
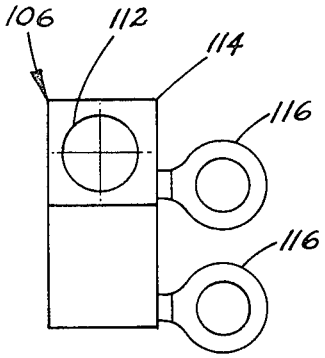
FIG. 11 is a top plan view of another element which may be used in the valve assemblies of FIGS. 1, 2 and 3.
Figure 12:
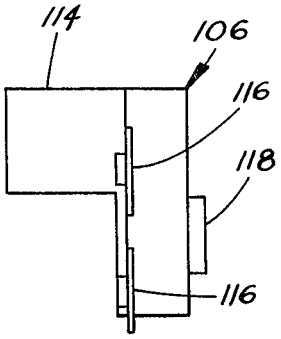
FIG. 12 is a right side view of the element of FIG. 11.
Figure 13:
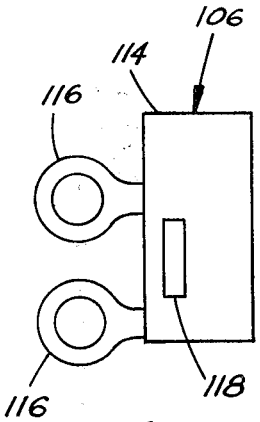
FIG. 13 is a bottom view of the element in FIG. 11.
Figure 10:
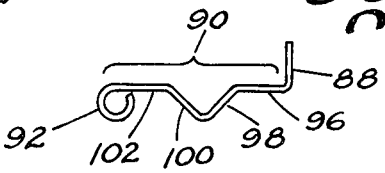
FIG. 10 is a view of one of the additional component parts of the FIG. 8 assembly, but shown by itself.
Figure 14:
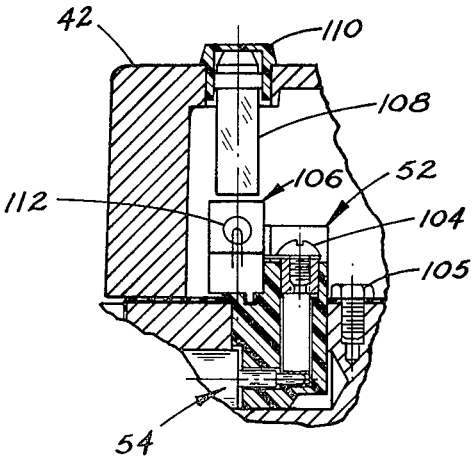
FIG. 14 is a fragmentary front vertical sectional view illustrating the element of FIGS. 11, 12, and 13 assembled into the valve of FIG. 1.

FIGS. 11, 12 and 13 illustrate an optional element which may be used with the assembly. This element is a light assembly 106. FIG. 14 illustrates the light assembly mounted on the valve of FIG. 1 and includes additional elements which are utilized in conjunction with the light assembly. These additional elements are a light pipe 108 and a lens 110. The purpose of this additional structure is to provide an option whereby associated with an individual solenoid assembly is a visual indicator which can provide to an observer an indication as to whether the associated solenoid is being energized. For example in the valve of FIG. 1 there could be an indicator light associated with each of the two solenoids. When one of the solenoids is energized, the corresponding lamp assembly is energized to provide via the corresponding light pipe and lens a visual indication to an observer of the fact of energization of that particular solenoid, the indicator being located in immediate proximity to the solenoid whose energization it is intended to indicate. The illustrated light assembly 106 comprises lamp 112 embedded within an enclosure 114. To one side of the enclosure 114 are a pair of eyelet terminals 116 each of which is electrically connected to one side of the indicating lamp. Terminals 116 are arranged to register with the annular terminals 68 of the corresponding terminal block assembly. For the valve of FIG. 1, if it is desired to use the lamp indicating option, then the terminals 116 are placed over the annular terminals 68 and then the wiring eyelet terminals are appropriately arranged and the screws 104 used to secure all these components in assembly. A locating tab 118 is provided on the bottom of the enclosure to properly locate the lamp assembly in relation to the terminal block assembly by engagement with a corresponding rectangular slot 122 (FIG. 4) in terminal block 64. Each lens 110 mounts on the junction box cover 42 and the upper end of the corresponding light pipe 108 is retentively engaged with the lens. In this way in the illustrated valve, the lenses and light pipes for the two solenoids are removed from their operative position over the corresponding light assembly when the junction box cover is removed.

Figure 2:
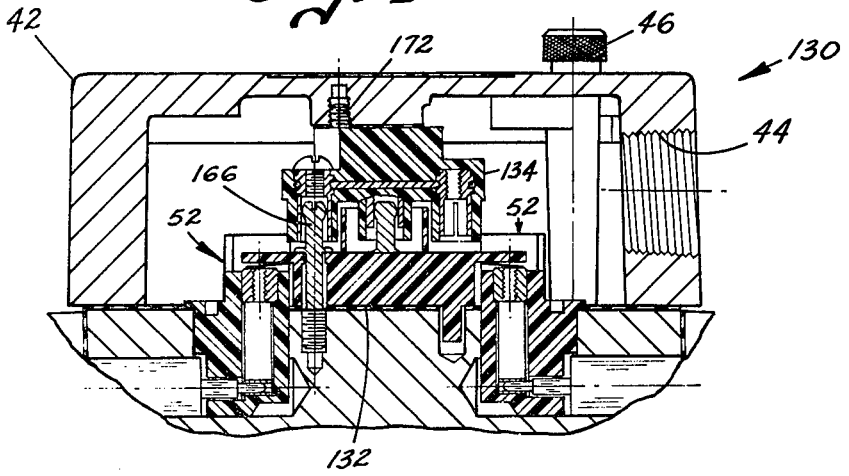
FIG. 2 is a fragmentary front vertical sectional view of another embodiment of solenoid valve embodying principles of the present invention.

FIG. 2 discloses another embodiment of directional valve 130 embodying principles of the invention. Valve 130 is similar to valve 30 of FIG. 1 insofar as it incorporates the terminal block assemblies 52 and the dual solenoid assemblies 34, 36. Valve 130 differs from valve 30 in that the junction box cover may be reversed 180° from the position shown in FIG. 2 about a central vertical axis of the valve whereby a conduit containing the wiring to the valve may enter on the left-hand side as viewed in FIG. 2, if the wiring comes from that direction. For this purpose the assembly comprises two additional major component parts, namely an adapter assembly 132 and a connector plug assembly 134.

The basic concept of the 180° reversible junction box cover is disclosed in the aforementioned cross referenced patent application. However, the present invention in one of its respects provides a new and improved construction for implementation of this feature. The adapter assembly is disposed on the top side of the valve body where it is covered by the junction box cover. The adapter assembly functions as a bridge to provide electrical conductive paths between the connector plug assembly 134 and the two terminal block assemblies 52. The lead wires which enter the junction box are connected to appropriate terminals in the connector plug assembly 134 (as will be explained later), and the mating connection between the connector plug assembly and the adapter assembly in turn provides an individual conductive path for each incoming wire to the corresponding conductive path of each terminal block assembly.

Details of adapter assembly 132 are shown in FIGS. 16 through 19. The adapter assembly comprises an adapter block 136 constructed of electrically non-conductive material, for example a suitable plastic. The adapter block is shown by itself in FIGS. 17 and 18. For the double solenoid valve there are four individual circuit paths which are provided by the adapter assembly, and accordingly the adapter block is provided with four circular holes 138 uniformly spaced in a straight line as shown.

Figure 16:
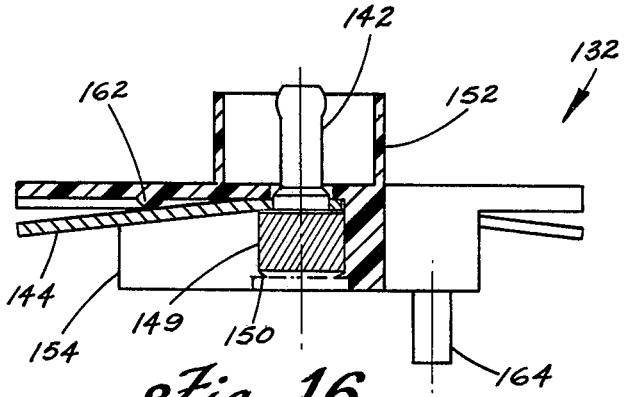
FIG. 16 is a front vertical sectional view through another element of the valve assemblies of FIGS. 2 and 3.

Associated with each of the holes 138 is a terminal arrangement comprising a generally cylindrical plug-in type terminal 142 and a cantilever type spring blade terminal 144 (see FIG. 16). As can be understood from consideration of the drawing figures, each cantilever terminal 144 has an annular portion 146 defining a circular aperture 148. Each terminal 142 comprises an enlarged base 149 and assembly of the terminals to the block is effected by first passing the tip of terminal 142 through the aperture 148 and then through the bottom of hole 138 so that the annular portion 146 is securely retained between the enlarged base of the terminal 142 and the wall surrounding hole 138. The terminals are secured in assembly on the adapter block by any suitable means, for example by staking as indicated by the reference numeral 150. The adapter block includes a walled partition structure 152 on the top around the tip of each terminal 142. There is also a walled partition structure 154 on the bottom around the base of each terminal 142 and the terminals 144. This lower partition structure provides cavities 156 corresponding in shape to the terminals 144. A pair of lateral flanges 158 are provided on each side of the adapter and include rectangular slots 160.

FIG. 16 illustrates the free position of the assembled cantilever terminals in the adapter block apart from the valve. It will be observed that a small protuberance 162 is provided within each cavity 156 on the wall which overlies the cantilever terminal. This flexes the cantilever from the flat shape which it would have by itself apart from the assembly. When the assembly is mounted onto the valve assembly, each cantilever terminal is further flexed to resiliently urge its distal end against the flat top of the corresponding annular terminal 68 of the underlying terminal block.

Figure 19:
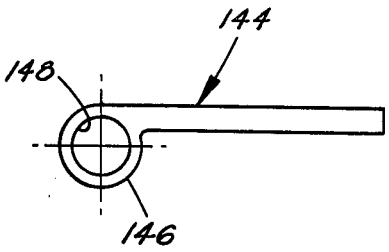
FIG. 19 is a plan view of a component part of the FIG. 16 element, but shown by itself.
Figure 17:
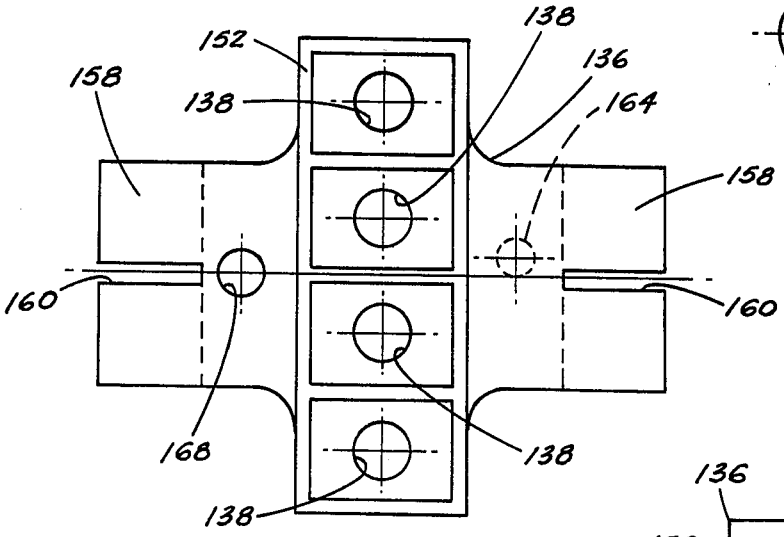
FIG. 17 is a top plan view of the element of FIG. 15 but with portions removed.
Figure 18:
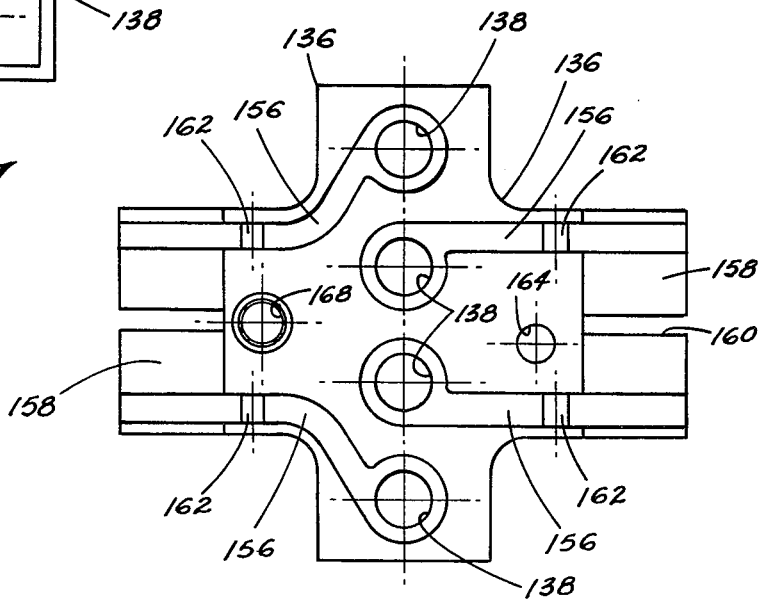
FIG. 18 is a bottom view of FIG. 17.

There are two cantilever blades projecting laterally to either side of the adapter assembly for engagement with the corresponding terminal block assembly 52. The shape of the outermost of the two cavities 156 as shown in FIG. 18 differs somewhat from that of the inner two. This is for the purpose of maintaining the same spacing distance between the distal ends of the cantilevers on each side of the assembly for engagement with the terminals of the terminal block aasemblies. FIG. 19 illustrates the shape of one of the cantilever terminals (by itself) which would be located in one of the inner cavities 156. It will be appreciated that the terminals for the outer cavities 156 would have shapes corresponding to their cavities.

Figure 3:
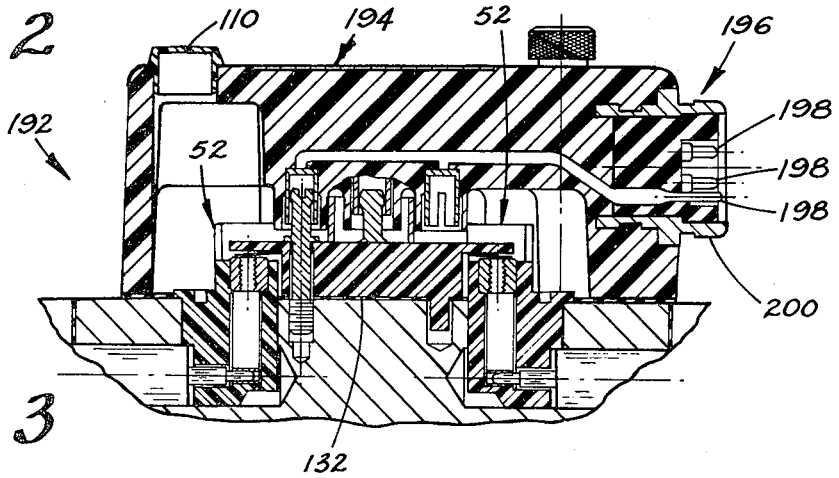
FIG. 3 is a fragmentary front vertical sectional view of still another embodiment of solenoid valve according to the present invention.
Figure 8:
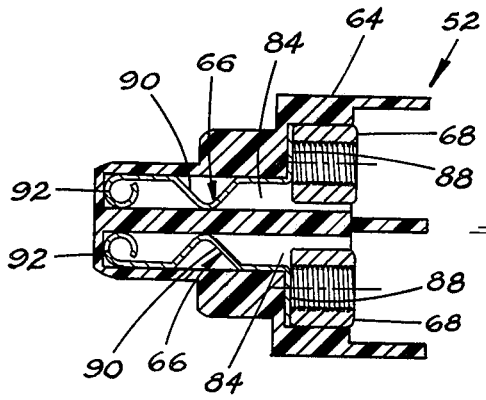
FIG. 8 is a sectional view through the element of FIG. 4 taken in the same direction as the view of FIG. 5 and including additional component parts.

When the adapter assembly is mounted on the valve, slots 160 engage the central partitions 82 of the terminal blocks thereby relatively locating the adapter. There is also a locating pin 164 on the underside of the adapter block which further locates the adapter relative to a hole in the valve body as best seen in FIGS. 2 and 3. The adapter assembly is held in place by means of a fastener 166 shown in FIG. 2 and passing through a hole 168 in the adapter block. The fastener may perform the dual function of providing for attachment of the adapter assembly to the valve while at the same time providing a ground terminal for grounding valve body 38 to an appropriate terminal of connector plug assembly 134. As the fastener is tightened to draw the adapter assembly against the valve body the spring cantilevers flex against the flat top surfaces of the respective terminals 68. In this way the appropriate circuit continuity through the adapter assembly and the terminal block assemblies to solenoids is established.

The details of the connector plug assembly 134 are shown in FIGS. 22 through 25. These figures show the connector plug assembly by itself apart from the valve. When installed, the connector plug assembly is secured to the top inside wall of junction box cover 42 by means of a pair of screws 172 (FIG. 2) which pass upwardly through apertures 174 (FIG. 22) in the connector plug assembly. This renders the connector plug assembly engageable with the adapter assembly integral and concurrent with the act of mounting the junction box cover on the valve. The connector plug assembly comprises a connector block 176 of electrically non-conductive material, the apertures 174 being provided in the block as shown. The assembly includes a plurality of six individual electrical terminals 178 which fit slightly loose to compensate slight misalignments of terminals 142. Four of the terminals 178 are aligned in a row corresponding to the alignment of the four terminals 142 of the adapter assembly. The other two terminals 178 are at right angles to the first-mentioned group of four terminals and these two are utilized in conjunction with the grounding circuit involved in grounding the various component parts. As best seen perhaps in FIGS. 22 and 23 there is a formed grounding rod 180 which engages the two grounding terminals 178 and is formed into a loop 182 at one of the two apertures 174. This loop 182 is arranged such that the attachment screw 172 which passes through that aperture makes electrical contact with the grounding rod to establish a common ground between the junction box cover and the two grounding terminals 178 when the connector plug assembly is mounted on the junction box cover. Furthermore, as can be seen from FIG. 2 when the valve is fully assembled, one of the grounding terminals 178 engages the head end of the fastener 166 to ground the valve body 38. In this way metal component parts (i.e the junction box cover and the valve body) are effectively grounded via a ground wire which is brought into the junction box cover along with the incoming wires to the solenoids.

Figure 25:
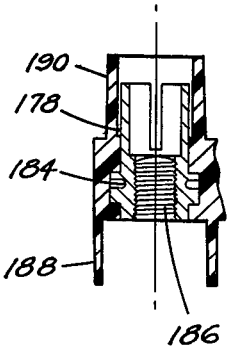
FIG. 25 is a fragmentary sectional view taken along line 25—25 in FIG. 22.
Figure 24:
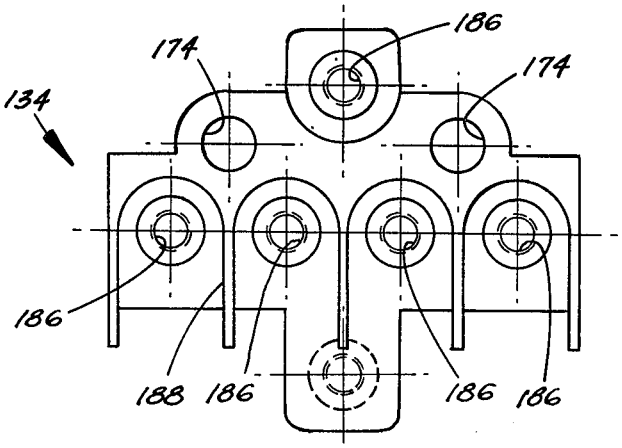
FIG. 24 is a top view of FIG. 22.

FIG. 25 illustrates a typical construction for one of the terminals 178. A groove 184 is provided around the outside of the cavities for the purpose of enabling the two ground terminals 178 to be grasped by the looped ends of the grounding rod 180. The upper end of each terminal 178 as viewed in FIG. 2 includes a threaded aperture 186. Instead of the screws 104 attaching the wires directly to the terminal block as in FIG. 1, the FIG. 2 embodiment has the incoming wires connected via the screws 104 to the terminals 178 by inserting one of the screws 104 onto the eyelet at the end of the particular lead wire and into the corresponding threaded aperture 186. The connector plug includes a partition structure 188 on the top side thereof for orienting the wire eyelets so as to avoid any contact between them when they are mounted on the connector plug. There is also an appropriate walled structure 190 around the lower portion of each terminal.

In view of the symmetrical construction of the connector plug structure and its symmetrical mounting on the junction box cover, it will be recognized that the junction box cover may be removed from the FIG. 2 position to disengage the connector plug from the adapter assembly, then rotated 180°, and finally remounted to once again mate the connector plug with the adapter assembly. By arranging the circuit connections such that the outer two terminals of the four aligned terminals go to one solenoid and the two inner terminals go to the other soleniod, proper continuity of the incoming wires to the correct solenoid is assured regardless of whether the junction box cover is in the FIG. 2 position or rotated 180° from the FIG. 2 position.

Figure 20:
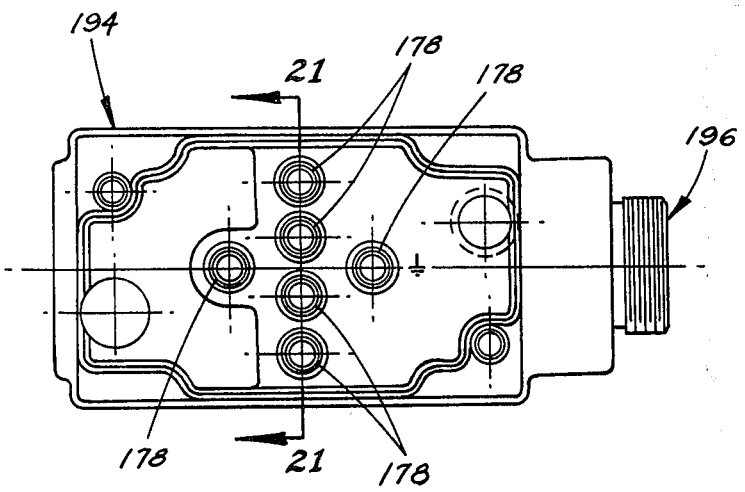
FIG. 20 is a bottom view of one of the elements of the valve of FIG. 3, shown by itself.
Figure 21:
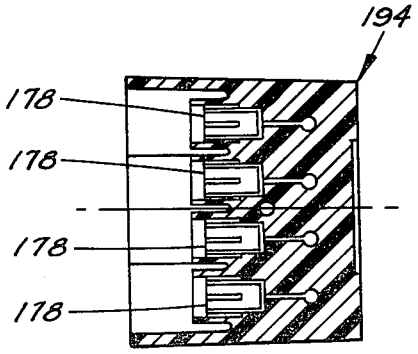
FIG. 21 is a sectional view taken along line 21—21 in FIG. 20.
Figure 22:
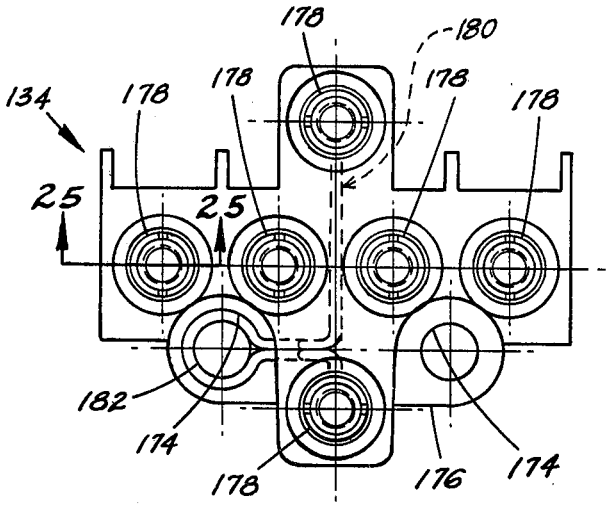
FIG. 22 is a bottom view of one of the elements of FIG. 2, shown by itself.
Figure 23:
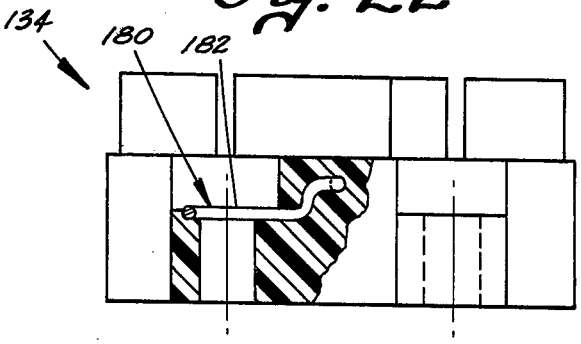
FIG. 23 is an elevation side view of FIG. 22, part sectional.

FIG. 3 illustrates a still further embodiment 192 of valve embodying principles of the present invention. The valve 192 is identical to valve 130 except with regard to the construction of the junction box cover and connector plug assembly. FIG. 3 differs from FIG. 2 in that the FIG. 3 structure has the connector plug and junction box cover as an integral unitary assembly 194 rather than having the connector plug a separate piece which is separably fastened to the junction box cover. The cover is hence a non-conductive material, preferably a rigid plastic. There is also a connector plug 196 at the right-hand side of the junction box cover of FIG. 3 comprising a number of individual terminals 198 corresponding to the individual wires which lead to the valve. This connector includes a threaded fitting 200 and the incoming wires to the valve would terminate in a mating electrical connector and fitting (not shown) which is tightened onto fitting 200 in order to secure the engagement of the mating terminals. The embodiment of FIG. 3 has the same capability as that of FIG. 2 in that the junction box cover may be removed and rotated 180° and then remounted while maintaining proper circuit continuity to the respective solenoids. In the drawing FIGS. 20 and 21 which illustrate details of the integral connector plug structure of valve 192, like reference numerals designate like parts from the FIG. 2 embodiment and in view of the earlier description it is believed unnecessary to discuss these in detail. Suffice it to say that the terminals 178 are molded in place, along with the plug structure 196, with connecting wires between terminals 178 and terminals 198 also being molded in place.

Figure 15:
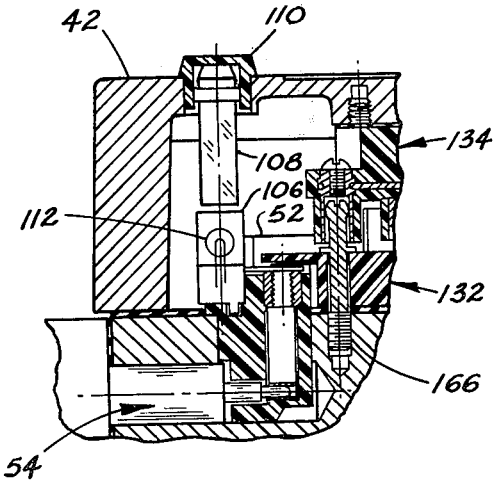
FIG. 15 is a fragmentary front vertical sectional view illustrating the element of FIGS. 11, 12, and 13 assembled into the valve of FIG. 2.

FIG. 15 illustrates the indicator lamp feature applied to valve 130. As can be seen, the lamp assembly mounts in exactly the same way as in the FIG. 14 embodiment except that instead of the screws 104 being used for fastening, the overlying flange of the adapter block and cantilever terminals are drawn downwardly by the tightening of fastener 166 to retain the terminals 166 between the cantilever terminals 144 and the terminals 68 of the terminal block assembly. In view of the FIG. 15 disclosure it should be readily apparent that the same mounting is utilized in the valve embodiment shown in FIG. 3 when it is desired to incorporate the lamp option.

While the disclosed embodiments possess important functional attributes with respect to actual performance there are a number of other attributes which flow from the invention. The solenoids may be replaced simply by unplugging them from the valve and plugging in a new unit. The typical solenoid mounting involves simply a nut which is threaded onto a threaded rod to secure the solenoid on the valve. Thus the nut is removed, the old solenoid is removed and replaced by a new one, and the nut reinstalled. Replacement of solenoids is extremely quick and can be done even where the valves are in almost inaccessible positions. It will be observed there is no need to rewire the solenoids when they are replaced; the electrical connections are made integral and concurrent with the act of mounting the solenoid to the valve. It would be possible to replace the solenoids without the presence of a skilled technician such as an electrician.

Also the valves may be fabricated as a base unit to which various options may be selectively added as desired. For example it would be possible to start with the base unit of FIG. 1. To this unit different types of junction box covers could be adapted if desired. Also the indicator lights may be optionally added as desired. Similarly the optional lights may be added to the FIG. 2 or FIG. 3 embodiments as desired. With this capability not only is there elimination of any rewiring when it becomes time to make modification, but further it can provide a simplified procedure for inventory control. Rather than having to stock a large range of individual valve models incorporating various features, all that is necessary is to inventory a basic valve unit and then selectively add options as desired. This can be done feasibly because of the vastly reduced time and cost which are required to disassemble a valve add the respective options and then reassemble it. Also the valves are efficient in usage of parts because whenever a modification is made the modification can be done nondestructively and without waste. For example, if the light option were incorporated into a valve, it could be readily removed and used in another valve at a later date.

It should also be pointed out that while double solenoid valves have been disclosed herein principles of the invention are equally applicable to other numbers of solenoids such as a single solenoid. The disclosed embodiments are further advantageous in commonizing on use of parts. Note, for example, that all terminal blocks are identical and that all terminals 66 are identical. It is believed that the disclosure of the present application demonstrates that a significant advance has been made in the field of solenoid actuated valves which is especially important in these times where cost-effectiveness is so highly important.

What is claimed is:

1. In a solenoid operated directional valve comprising a valve assembly and a solenoid assembly assembled together, said valve assembly including a valve body and electrical means thereon via which energizing current for said solenoid assembly flows, an improved modularized electrical connector and terminal construction for said electrical means comprising:

a terminal block assembly comprising an electrical conductive path having plural terminations, means electrically connecting one of said plural terminations to the solenoid assembly;

an adapter assembly separably mounted with respect to the valve body comprising an electrically nonconductive block containing an electrical conductive path having plural terminations, one of said plural terminations of said electrical conductive path of said adapter assembly comprising a spring cantilever terminal which is resiliently flexed into mating electrical contact with another of the terminations of said terminal block assembly integral and concurrent with the act of mounting said adapter assembly with respect to said terminal block and said valve body, another of the terminations of said electrical conductive path of said adapter assembly comprising another terminal mounted on said adapter assembly block and also mounting said spring cantilever terminal on the adapter assembly;

a junction box cover assembly separably mounted with respect to said valve body and said adapter assembly and covering the adapter assembly, said junction box cover assembly comprising an electrical conductive path having plural terminations, one of said terminations of said electrical conductive path of said junction box cover assembly effecting mating electrical contact with said another of the terminations of said electrical conductive path of said adapter assembly integral and concurrent with the act of mounting the junction box cover assembly with respect to the valve body and the adapter assmebly;

and means providing for connection of another of the terminations of said electrical conductive path of said junction box cover to a source of energizing current for the solenoid whereby a current path between that source and said solenoid is provided by the conductive paths through the junction box cover assembly, the adapter assembly, and the terminal block assembly.

2. The improvement set forth in claim 1, wherein the solenoid assembly comprises a terminal which electrically mates with said one termination of said electrical conductive path of the terminal block assembly integral and concurrent with the act of mounting the solenoid assembly on the valve body.

3. The improvement set forth in claim 2, wherein the electrically conductive path of said terminal block assembly comprises a first terminal element formed from a metal strip and a second terminal element which is inserted into the terminal block assembly to retain the first terminal element thereon, said first terminal element constituting said one termination of said electrical conductive path of said terminal block assembly and said second terminal element constituting said another termination of said electrical conductive path of said terminal block assembly.

4. In a solenoid operated directional valve comprising a valve assembly and a solenoid assembly assembled together, said valve assembly including a valve body and electrical means thereon via which energizing current for said solenoid assembly flows, an improved modularized electrical connector and terminal construction for said electrical means comprising:

a terminal block assembly comprising an electrical conductive path having plural terminations, means electrically connecting one of said plural terminations to the solenoid assembly;

an adapter assembly separably mounted with respect to the valve body comprising an electrical conductive path having plural terminations, one of said plural terminations of said electrical conductive path of said adapter assembly effecting mating electrical contact with another of the terminations of said terminal block assembly integral and concurrent with the act of mounting said adapter assembly with respect to said terminal block and said valve body;

a junction box cover assembly separably mounted with respect to said valve body and said adapter assembly and covering the adapter assembly, said junction box cover assembly comprising an electrical conductive path having plural terminations, one of said terminations of said electrical conductive path of said junction box cover assembly effecting mating electrical contact with another of the terminations of said electrical conductive path of said adapter assembly integral and concurrent with the act of mounting the junction box cover assembly with respect to the valve body and the adapter assembly;

means providing for connection of another of the terminations of said electrical conductive path of said junction box cover to a source of energizing current for the solenoid whereby a current path between that source and said solenoid is provided by the conductive paths through the junction box cover assembly, the adapter assembly, and the terminal block assembly;

and wherein said electrical conductive path of said terminal block assembly comprises a conductive member and said one termination of said electrical conductive path of said adapter assembly comprises a spring cantilever member having a distal surface which is disposed in contact with said conductive member of said terminal block assembly and said adapter assembly includes means causing the spring cantilever member to be resiliently flexed when the adapter assembly is mounted with respect to the valve body and the terminal block assembly such that the spring cantilever member exerts a force urging the distal surface thereof forceful contact with said conductive member of said terminal block assembly.

5. The improvement set forth in claim 4, wherein said adapter assembly comrpises an electrically non-conductive block on which said electrical conductive path of said adapter assembly is mounted and said another termination of said electrical conductive path of said adapter assembly is an elongate terminal having diametrically reduced and diametrically enlarged portions, said cantilever member comprising an annular portion, the diametrically reduced portion of said elongate terminal passing through the aperture defined by the annular portion of said cantilever member, said annular portion being retained between the diametrically enlarged portion of the elongate terminal and a wall portion of the block of said adapter assembly, said wall portion including an aperture through which the diametrically reduced portion of the elongate terminal extends.

6. The improvement set forth in claim 5, wherein said wall portion includes an adjacent flange which extends laterally of the length of the elongate terminal, said cantilever member extending laterally of the length of the elongate terminal on one side of said flange, and including a protuberance on said one side of said flange engaging the cantilever member at a location between the distal end surface thereof and the annular portion thereof to cause the cantilever member to be resiliently flexed against said conductive member of the terminal block assembly.

7. In a solenoid operated directional valve comprising a valve body having a solenoid at one end of the valve body and a junction box cover disposed on a surface of the valve body adjacent the end of the valve body on which the solenoid is mounted and further comprising an electrical plug connector on the junction box cover via which electrical power is supplied to operate the solenoid, an adapter assembly for providing electrical circuit continuity between the electrical plug connector on the junction box cover and the solenoid comprising an adapter block of electrically non-conductive material, terminals on the adapter block for engagement with corresponding terminals of the connector plug, spring cantilever terminals on the adapter block each associated with a corresponding one of the first-mentioned terminals of the adapter block, each cantilever terminal comprising an annular portion defining an aperture through which the corresponding one of said first-mentioned terminals passes, means mounting each annular portion and the corresponding one of the first-mentioned terminals in electrical contact with each other on the adapter block, each cantilever terminal being disposed in relation to the adapter block to be resiliently flexed into electrical contact with a corresponding terminal associated with the solenoid when the adapter assembly is assembled to the valve.

8. In a solenoid operated directional valve comprising a valve assembly and a solenoid assembly assembled together, said valve assembly including a valve body and electrical means thereon via which energizing current for said solenoid assembly flows, an improved electrical connection between said solenoid assembly and said electrical means for effecting electrical connection of said solenoid assembly to said electrical means integral and concurrent with the act of moving the two assemblies along a given direction into assembly with each other comprising;

at least one electrically conductive terminal on said solenoid assembly via which energizing current for the solenoid assembly flows;

at least one electrically conductive terminal on said valve assembly each of which corresponds to and is mated with a corresponding one of said terminals on said solenoid assembly;

each such pair of mated terminals comprising mated elongate portions which are elongate in the direction via which the two assemblies are moved into assembly with each other;

one terminal of each such pair of mated terminals being mounted on an electrcially non-conductive terminal block which is mounted on the corresponding assembly;

said one terminal of each such pair comprising a strip one lengthwise end of which is fixedly mounted on the terminal block and the opposite lengthwise end of which is free and curled to form the elongate portion of said one terminal with the direction of elongation being transverse to the length of said strip, said strip including a compliant portion between said ends thereof which permits limited movement of its free end relative to its fixed end whereby the elongate portions of each such pair of terminals are readily mated during assembly of the solenoid assembly and valve assembly and are rendered substantially immune to relative movement when the valve is in use.

9. The improvement set forth in claim 8 in which the curled free end of each such strip is curled into a substantially tubular shape including an outwardly flared lead which facilitates engagement by the mating elongate portion.

10. The improvement set forth in claim 8 in which said compliant portion of each such strip comprises a V-shaped segment joining straight aligned segments of the strip.

11. The improvement set forth in claim 8 in which said one end of each such strip is bent at an angle relative to an immediate adjacent segment of the strip thereby forming a flanged tab, each such strip fixedly mounted on its corresponding terminal block by a separate electrically conductive element which engages said flanged tab.

12. The improvement set forth in claim 11 in which each such separate electrically conductive element is an annular threaded element disposed in a hole in the corresponding terminal block.

13. In a solenoid operated directional valve comprising a valve assembly, a solenoid assembly at one end of the valve assembly, and incoming electrical power at another location on the valve assembly via which electrical power is supplied to operate the solenoid assmebly, a terminal block assembly for providing electrical continuity between the incoming electrical power and the solenoid assembly comprising an electrically non-conductive terminal block having a passage one end of which is open toward the incoming electrical power and an opposite end of which is open toward the solenoid assembly, two electrically conductive terminal portions disposed in said passage, one terminal portion comprising an elongate strip extending lengthwise through said passage, the other terminal portion comprising an annular element which is disposed in said passage at said one passage end and has electrical contact with one lengthwise end of said strip to fixedly mount that end of the strip on the terminal block, the opposite end of the strip being free and curled to form a receptacle whose axis is transverse to the length of said strip and which is disposed at said opposite passage end, and said annular element and said receptacle at said opposite end of said strip being points of connection for the incoming electrical power and the solenoid assembly.

14. A terminal block assembly as set forth in claim 13 in which said annular element and said strip are separate pieces and said annular element comprises an internal screw thread and said strip comprises a flanged tab at said one lengthwise end against which said annular element is disposed to fixedly mount that end of the strip on the terminal block.

15. A terminal block assembly as set forth in claim 14, said strip including a compliant portion between said ends thereof which permits limited movement of its free end relative to its fixed end.

16. In a solenoid operated directional valve comprising a valve assembly and a solenoid assembly assembled together, said valve assembly including a valve body and electrical means thereon via which energizing current for said solenoid assembly flows, and a junction box cover for said electrical means, an improved electrical connection between said solenoid assembly and said electrical means for effecting electrical connection of said solenoid assembly to said electrical means integral and concurrent with the act of moving the two assemblies along a given direction into assembly with each other comprising:

a passage in said valve body which is open toward said junction box cover at one end and which is open toward said solenoid assembly at an opposite end;

an electrically non-conductive terminal block disposed within said passage, said terminal block comprising its own passage which is open toward said junction box cover at one end and which is open toward said solenoid assembly at an opposite end;

an electrically conductive terminal disposed within the passage of said terminal block;

an electrically conductive terminal on said solenoid assembly which is mated with the terminal of said terminal block and which projects from a protuberance of said solenoid assembly which in turn projects from a second protuberance of said solenoid assembly;

said second protuberance having a close fitting engagement with said opposite end of said valve body passage and said first protuberance having a close fitting engagement with said opposite end of said terminal block passage, said two protuberances and said opposite ends of said passages being relatively dimensioned such that during assembly of the solenoid assembly to the valve assembly said second protuberance engages said valve body passage in close fitting relationship before said first protuberance engages said terminal block passage in close fitting relationship and before said two terminals become mated.

17. The improvement set forth in claim 16 in which the terminal of said terminal block comprises a strip one lengthwise end of which is fixedly mounted on the terminal block and the opposite lengthwise end of which is free and curled to form an elongate receptacle for the mating portion of the solenoid terminal with the direction of elongation being transverse to the length of the strip, and said strip including a compliant portion between its lengthwise ends which permits limited movement of its free end relative to its fixed end.

* * * * *